US006190420B1

(12) United States Patent
Reynolds

(10) Patent No.: US 6,190,420 B1
(45) **Date of Patent: *Feb. 20, 2001**

(54) DRY-CLEANING ARTICLE, COMPOSITION AND METHODS

(75) Inventor: Rayvon E. Reynolds, Lilburn, GA (US)

(73) Assignee: Dry, Inc., Portland, OR (US)

( * ) Notice: Under 35 U.S.C. 154(b), the term of this patent shall be extended for 0 days.

This patent is subject to a terminal disclaimer.

(21) Appl. No.: 09/416,522

(22) Filed: Oct. 8, 1999

Related U.S. Application Data

(63) Continuation of application No. 09/170,755, filed on Oct. 13, 1998, now Pat. No. 5,965,504.

(51) Int. Cl.[7] ..... D06L 1/02

(52) U.S. Cl. ..... 8/142; 8/137; 510/277; 510/285; 510/291; 510/295

(58) Field of Search ..... 8/137, 142; 510/277, 510/285, 291, 295

(56) References Cited

U.S. PATENT DOCUMENTS

| | | | | |
|---|---|---|---|---|
| 3,261,185 | | 7/1966 | Rihr | 68/213 |
| 3,432,253 | | 3/1969 | Dixon et al. | 8/142 |
| 3,593,544 | | 7/1971 | Henderson | 68/12 |
| 3,776,853 | | 12/1973 | Minter | 252/171 |
| 3,827,857 | | 8/1974 | Boulus | 8/137 |
| 3,907,496 | | 9/1975 | Néel et al. | 8/142 |
| 3,920,389 | | 11/1975 | Eanzel | 8/142 |
| 3,933,425 | | 1/1976 | Grünewälder et al. | 8/142 |
| 4,077,878 | | 3/1978 | Jackson | 210/59 |
| 4,176,080 | | 11/1979 | Wise et al. | 252/162 |
| 4,234,627 | | 11/1980 | Schilling | 427/242 |
| 4,336,024 | | 6/1982 | Denissenko et al. | 8/142 |
| 4,659,332 | * | 4/1987 | Hellsten | 8/142 |
| 4,790,856 | | 12/1988 | Wixon | 8/137 |
| 5,082,466 | | 1/1992 | Rubenstein et al. | 8/142 |
| 5,196,132 | | 3/1993 | Mains et al. | 252/90 |
| 5,238,587 | * | 8/1993 | Smith et al. | 252/8.6 |
| 5,442,938 | | 8/1995 | Kislyuk | 68/5 C |
| 5,504,954 | | 4/1996 | Joo et al. | 8/158 |
| 5,547,476 | * | 8/1996 | Siklosi et al. | 8/142 |
| 5,591,236 | | 1/1997 | Roetker | 8/137 |
| 5,630,847 | | 5/1997 | Roetker | 8/137 |
| 5,630,848 | * | 5/1997 | Young et al. | 8/137 |
| 5,632,780 | | 5/1997 | Siklosi | 8/137 |
| 5,658,651 | | 8/1997 | Smith et al. | 442/59 |
| 5,687,591 | | 11/1997 | Siklosi et al. | 68/212 |
| 5,746,776 | | 5/1998 | Smith et al. | 8/142 |
| 5,858,022 | * | 1/1999 | Romack et al. | 8/142 |
| 5,965,504 | | 10/1999 | Reynolds | 510/285 |
| 6,013,614 | | 1/2000 | Mahdessian | 510/277 |
| 6,024,767 | | 2/2000 | Telesca et al. | 8/142 |
| 6,045,588 | | 4/2000 | Estes et al. | 8/142 |
| 6,048,368 | | 4/2000 | Tcheou et al. | 8/137 |

FOREIGN PATENT DOCUMENTS

| | | |
|---|---|---|
| WO 96/30583 | 10/1996 | (WO) . |
| WO 97/00738 | 1/1997 | (WO) . |

* cited by examiner

*Primary Examiner*—Mark Kopec
*Assistant Examiner*—Brian P. Mruk
(74) *Attorney, Agent, or Firm*—Kolisch Hartwell Dickinson McCormack & Heuser

(57) ABSTRACT

The invention is directed to a dry-cleaning article suitable for use in the home. The article is characterized by a sheet that is permeated with a composition including 51–98% by weight of organic solvent such as paraffins, olefins, acetylenes or mixtures thereof, 1–35% by weight of water, and 1–14% by weight of emulsifier to allow the water to be uniformly mixed into the solvent. The composition can also include 1–5% by weight of perfume for scenting clothing, and 1–5% by weight of nonionic and/or anionic surfactant to provide additional stain removal capability of the composition. The invented composition is thus organic-solvent-based and is particularly effective to remove body or cosmetic oil stains from garments. The invention is also directed to the composition and methods for using the sheet in a drying machine.

48 Claims, No Drawings

DRY-CLEANING ARTICLE, COMPOSITION AND METHODS

RELATED APPLICATION

This is a continuation application of copending application Ser. No. 09/170,755, which was filed on Oct. 13, 1998, issued as U.S. Pat. No. 5,965,504 on Oct. 12, 1999, and the disclosure of which is hereby incorporated by reference.

FIELD OF THE INVENTION

This invention is directed to a dry-cleaning composition, article and methods that can be used for garment freshening and cleaning.

BACKGROUND AND SUMMARY OF THE INVENTION

U.S. Pat. No. 5,547,476 (hereinafter referred to as "the '476 patent") issued Aug. 20, 1996 to Siklosi et al. discloses a home dry-cleaning process. In the process of the '476 patent, a carrier sheet is releasably impregnated with a cleaning composition. The sheet and clothing to be cleaned are sealed in an air-tight bag that is placed in a dryer. As the dryer's drum heats and rotates, the sheet releases the cleaning composition to clean the clothes contained in the bag. The cleaning composition disclosed in the '476 patent includes water, etherfied propanol solvent, 1,2-octanediol, and an emulsifier. The specific requirement to use etherfied propanol solvent is disadvantageous in that there are many types of common garment stains that cannot be cleaned effectively with this substance. In addition, etherfied propanol can remove colors, particularly in garments made of silk. In addition, 1,2-octanediol is not a widely available substance, and the requirement that it be used in the composition of the '476 patent increases the cost of the composition. In addition, all embodiments of the '476 patent disclose water-based compositions in which water constitutes the largest constituent. Although such water-based compositions are effective in removing some types of garment stains, commonly occurring stains such as body or cosmetic oils are not effectively removed with water-based cleaning compositions, and such large amounts of water can remove color from garments.

U.S. Pat. No. 5,238,587 (hereinafter referred to as "the '587 patent") discloses a composite fabric-cleaning article including a flexible porous base sheet with a coating of a gelled cleaning composition. In a manner similar to the '587 patent, the sheet is placed in an air-fight bag with clothing, which is sealed and placed in a dryer. The composition includes about 60–90% water, about 0.25–5% gelling agent, about 2–32% of a water miscible organic solvent and about 5–10% surfactant. Thus, like the composition of the '476 patent, the composition of the '587 patent is water-based and accordingly relatively ineffective in cleaning garment stains caused by body or cosmetic oils, and such large amounts of water can remove color from some garments. It would be desirable to provide a dry-cleaning kit suitable for use in the home, that is effective in cleaning the oil-based garment stains for which dry-cleaning is most often required.

DISCLOSURE OF THE INVENTION

This invention overcomes the above-noted disadvantages. The dry-cleaning article of this invention is characterized by a sheet that is permeated with an organic solvent and water, and optionally other substances, in which organic solvent is the largest constituent by weight of all substances permeated in the sheet. In one embodiment, the sheet is permeated with 51–98% by weight of organic solvent, and 1–35% by weight of water. As used herein, the weight percentages of the substances reflect the range of proportions of the substances relative to all substances permeated in the sheet. The organic solvent and water can also be mixed into a composition with 1–14% by weight of emulsifier to allow the water to be uniformly mixed into the solvent before permeation into the sheet. The sheet can also be permeated with 1–5% by weight of a perfume substance for scenting clothing and/or 1–5% by weight of nonionic and/or anionic surfactant substance to provide additional stain removal capability. The substances permeated into the invented article are thus organic-solvent-based and as such are particularly effective in removing body or cosmetic oil stains from garments. The above-stated substances can be permeated separately into the same or different areas of the sheet, or can be mixed together into a uniform composition and then permeated into the sheet.

In one preferred method for using the dry-cleaning sheet, the sheet is placed within a dryer along with clothing to be dry-cleaned and is allowed to tumble with the clothing at 40°–90° Celsius for five to forty-five minutes. The organic solvent and water in the sheet act upon the clothing and remove oil-based stains during tumbling in the dryer.

A second preferred method of the invention is particularly useful if the clothing to be dry-cleaned has delicate buttons or trim. The clothing is placed in a container such as a perforated bag along with a sheet permeated with organic solvent, water and optionally the other substances as stated above, and is tumbled in a dryer under the same range of temperatures and time durations as stated above with respect to the first method. After tumbling in the dryer, the clothing is removed from the bag and is ready to be worn.

These together with other features and advantages, which will become subsequently apparent, reside in the details of construction and operation as more fully hereinafter described and claimed.

BEST MODE FOR CARRYING OUT THE INVENTION

In one embodiment of the present invention, a dry-cleaning sheet is permeated with substances which can be included in a composition characterized by 51–98% by weight of organic solvent. The organic solvent can include paraffins, olefins, acetylenes and mixtures thereof. A preferred organic solvent is referred to in the chemical industry as "QED2," and is commercially available from Sentry Chemical, Inc. of Atlanta, Ga., US, although other specific types of organic solvent are suitable for use in the invention. QED2 organic solvent is particularly advantageous for use in the invention, however, because it is safe for home use, i.e., it has relatively low toxicity, in contrast to other types of chemicals such as perchloroethylene ("perc") which is widely used in the dry-cleaning industry but which is toxic and therefore requires commercial equipment for containment.

The preferred dry-cleaning composition is also characterized by 1–35% by weight of water. Preferably, however, the dry-cleaning composition includes water in a quantity less than 25% by weight so that the water will readily stabilize when mixed with the other substances included in the invented composition. The water in the composition serves several purposes. For one, water is of course effective in the removal of water-soluble stains from clothing, so its inclusion in the invented composition in limited amounts that will not remove significant color from garments is beneficial for this reason. Also, water is an effective agent in removing wrinkles from articles of clothing or other fabric items. Another factor which makes the inclusion of water beneficial in the invented composition is that organic solvents such as QED2 solvent ordinarily will ignite at relatively low temperatures, i.e., they generally have relatively low flashpoints. For example, QED2 solvent ignites at approximately 110° Celsius. The inclusion of water with the organic solvent in the invented composition is thus useful in raising the flashpoint of the composition so that it is much less likely to be accidentally ignited.

Because the organic solvent and water substances are generally immiscible, the invented composition can be characterized by 1–14% by weight of emulsifier substance to allow the water to be uniformly mixed into the solvent. The preferred mixture is 4% by weight of nonionic emulsifier and 1% by weight of anionic emulsifier. The nonionic and anionic emulsifiers that can be used in the invented composition are numerous and widely commercially available. Such emulsifiers include acrylates (e.g., acrylic acid, C10–30 alkyl acrylate crosspolymer, alkyl methacrylate copolymer), polyacrylic acid, carbomers (e.g., carboxyvinyl polymer), and oleyl alcohol 20 mole ethoxylate. Examples of anionic emulsifiers include substances commercially available under the trademarks PEMULEN™ and CARBOPOL™, and examples of nonionic emulsifiers include substances commercially available under the trademarks EMULIUN™ and EMULPHOR™. Such emulsifiers are commercially available from a large number of sources, including B.F. Goodrich Company of Richfield, Ohio, US, Stepan Company of Northfield, Ill., US, and Sentry Chemical Co. of Atlanta, Ga., US.

The composition can also be characterized by 1–5% by weight of a perfume substance for scenting clothing. Such perfume can include numerous scents which are commercially available from a large number of sources, including Ungurer, Inc. of Lincoln Park, N.J.

In addition, for enhanced stain removal capability, the invented composition can be characterized by 1–5% by weight of surfactant substance, preferably nonionic or anionic, such as nonyl phenoxy polyethoxy ethanol commercially available from Sentry Chemical of Atlanta, Ga., US.

The invented composition is preferably made by mixing appropriate amounts of the emulsifier with the water in a containment vessel using a glass rod or the like. The resulting mixture is poured into the organic solvent in another containment vessel while stirring until a stable emulsion forms. Generally, water is preferred to be used in the composition in a quantity that is less than 25% by weight so that the mixture forms a stable emulsion upon mixing the solvent, water and emulsifier together. If used, the perfume and surfactant can be mixed into the emulsion to finish the formulation of the invented composition.

The article of this invention includes a sheet that is permeated with the invented composition. Alternatively, the same or different portions of the sheet can be permeated with organic solvent and water, and optionally also perfume and surfactant. The organic solvent constitutes 51–98% by weight of all substances permeated in the sheet, water constitutes 1–35% by weight of the substances permeated in the sheet, and emulsifier constitutes 1–14% by weight of the substances permeated into the sheet. The sheet can also be permeated with perfume which constitutes 1–5% by weight of all substances permeated in the sheet, and surfactant which constitutes 1–5% by weight of all substances permeated in the sheet. The sheet is preferably a low-cost pliable material that is absorbent to allow the above-stated substances to be permeated therein, and that is also not prone to deterioration in a dryer. Such sheet can be a non-woven fabric, paper towel, fibrous batting or the like made from cotton, rayon, polyester fibers or wood pulp. Preferably, the sheet material is square or rectangular in shape and is from ten to four-hundred square centimeters in size. The total volume of the substances permeated in the sheet are preferred to be about twenty (20) cubic centimeters or less.

In a mass production context, the invented composition is poured from one or more perforated conduits onto a continuous sheet moving on a conveyor, for example, down a production line. The composition can be spread with a doctor's blade, a rod or the like which is positioned closely to the sheet material downstream of the conduit with respect to the direction of movement of the sheet material in the production line. The composition is thus spread out so that it permeates the sheet uniformly. Alternatively, the composition can be provided to the conduit under pressure and sprayed through its perforations onto the sheet material as it advances along the conveyor. If the organic solvent and water are not mixed into a composition with an emulsifier, separate conduits and/or spray nozzles can be provided for the organic solvent, water and optionally is also perfume and/or surfactant, and used to apply these substances to the same or different portions of the sheet. The elongated sheet then can be cut with a knife or die cutter into sections that are preferably wrapped in individual foil packets and packaged into boxes or other containers for sale to consumers for use in home drying machines.

In the first preferred method, a sheet (preferably just after removal from its foil packet) is placed in a home dryer along with the clothing that is to be dry-cleaned. The clothing is then tumbled with the sheet for 5 to 45 minutes in air heated to a temperature of 40°–90° Celsius. Preferably, the clothing is tumbled with the sheet for at least 15 minutes at an air temperature over 50° Celsius. Due to the action of the substances released from the sheet by the heat of the dryer as well as the contact of the sheet with the clothing during tumbling, the clothing is cleaned of oil-based stains such as body or cosmetic oils as well as water-soluble materials. After tumbling, the clothing can be removed from the drying machine and worn.

In the second preferred method, the sheet is placed within a container such as an air-permeable bag, along with the clothing that is to be cleaned. The container is then closed and placed inside of the drying machine. The container is tumbled inside of the drying machine under similar air temperature conditions and time durations as stated above with respect to the first invented method, to clean the clothing in the container. After tumbling in the drying machine, the container is removed from the machine and the container is opened to extract the clothing that is ready to be worn. Preferably, the container is a bag made of nylon material that can withstand the elevated temperatures in the drying machine. Also, the bag is preferred to be perforated so that air flows easily through the bag to avoid wrinkling of the clothing therein. The perforations or openings for air flow in the bag are preferred to be much less than the size of buttons or trim on the clothing to be cleaned so that such clothing features do not extend through the openings in the bag and are thus protected from damage by the bag as the clothing tumbles in the dryer. Also, so that clothing can be readily placed into or taken out of the bag, the bag preferably defines an opening that can be closed with a drawstring or the like. The bag may be used repeatedly or may be disposable.

The many features and advantages of the present invention are apparent from the detailed specification and thus it is intended by the appended claims to cover all such features and advantages of the described composition, article and methods which follow in the scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the scope of the invention as defined by the claims.

Industrial Applicability

The invented article, composition and methods are applicable to the dry-cleaning industry. More specifically, the invented article, composition and methods are applicable to dry-cleaning of clothing or other objects in home drying machines.

I claim:

1. A dry-cleaning composition consisting of:

51–98% by weight of at least one organic solvent selected from the group consisting of olefins, parafins, acetylenes and mixtures thereof;

1–35% by weight of water;

1–14% by weight of emulsifier; and optionally, 1–5% by weight surfactant; and optionally, 1–5% by weight perfume.

2. A dry-cleaning composition as claimed in claim 1, wherein the perfume is present in the composition at 1–5%.

3. A dry-cleaning composition as claimed in claim 1, wherein the surfactant is present in the composition at 1–5% by weight.

4. A dry-cleaning composition as claimed in claim 3, wherein the surfactant includes nonyl phenoxy polyethoxy ethanol.

5. A method for cleaning and refreshing clothing, the method comprising the steps of:

a) placing clothing with a sheet in a drying machine, the sheet permeated with substances including 51%–98% by weight of an organic solvent; and 1%–35% by weight of water; and b) tumbling the sheet with the clothing in the drying machine at a temperature of at least 40° C. in heated air generated by the machine; and c) removing the clothing from the drying machine.

6. A method as claimed in claim 5, further comprising the step of:

d) permeating the sheet with the organic solvent and water before the performance of said step (a).

7. A method as claimed in claim 5, wherein the substances further include an emulsifier, the emulsifier constituting 1–14% by weight of the substances permeated in the sheet.

8. A method as claimed in claim 5, wherein the substances further include a perfume, the perfume constituting 1–5% by weight of the substances permeated in the sheet.

9. A method as claimed in claim 5, wherein the substances further include a surfactant, the surfactant constituting 1–5% by weight of the substances permeated in the sheet.

10. A method as claimed in claim 9, wherein the surfactant includes nonyl phenoxy polyethoxy ethanol.

11. A method as claimed in claim 5, wherein the sheet is pliable.

12. A method as claimed in claim 5, wherein the sheet is composed of at least one of a non-woven fabric, paper towel and fibrous batting.

13. A method as claimed in claim 5, wherein the organic solvent includes at least one of a paraffin, olefin, acetylene and mixtures thereof.

14. A method as claimed in claim 5, wherein the temperature of the heated air in the drying machine during the performance of said step (b) is in the range of 40° and 90° C.

15. A method as claimed in claim 5, wherein said step (b) is performed for at least fifteen minutes.

16. A method as claimed in claim 5, wherein the sheet moves freely with the clothing as the clothing tumbles in said step (b).

17. A method as claimed in claim 5, further comprising the steps of:

d) before the performance of said step (a), placing the clothing and the sheet in a container; and e) closing the container, said step (a) being performed by placing the closed container in the drying machine, said step (c) being performed by removing the container from the drying machine, the method further comprising the step of:

f) opening the container to remove the clothing.

18. A method as claimed in claim 17, wherein the container is a nylon bag.

19. A method as claimed in claim 18, wherein the nylon bag defines an opening that can be closed with a draw string.

20. A method as claimed in claim 19, wherein the nylon bag is air-permeable.

21. The method of claim 5, further comprising the steps of:

before the performance of said step (a), placing the clothing and the sheet in an air-permeable container.

22. The method of claim 21, wherein the air-permeable container includes a sealable opening.

23. The method of claim 21, wherein the air-permeable container includes a plurality of perforations through which air in the drying machine may flow through the container.

24. The method of claim 23, wherein the container includes an air-permeable bag.

25. The method of claim 23, wherein the container includes means for closing the opening.

26. The method of claim 24, wherein the air-permeable bag is formed from a nylon material, includes a resealable opening, and includes a drawstring adapted to selectively seal the opening.

27. The method of claim 5, wherein the placing step includes placing the clothing and the sheet in the drying machine without enclosing the clothing and the sheet in a container.

28. The method of claim 5, wherein the placing step includes placing the clothing and the sheet in a drying machine so that the clothing and sheet may tumble freely within the drying machine.

29. The method of claim 28, wherein the clothing and sheet are placed into the drying machine without enclosing the clothing and the sheet in a container.

30. The method of claim 6, wherein the organic solvent and water are permeated onto separate portions of the sheet.

31. The composition of claim 1, wherein the emulsifier includes a nonionic component and an anionic component.

32. The composition of claim 31, wherein the emulsifier includes a greater concentration of the nonionic component than the anionic component.

33. The composition of claim 3, wherein the surfactant includes an anionic surfactant.

34. The composition of claim 3, wherein the surfactant includes a nonionic surfactant.

35. The composition of claim 1, wherein the composition is permeated in an absorbent material.

36. The composition of claim 35, wherein approximately 20 cubic centimeters of the composition are permeated onto the absorbent material.

37. The composition of claim 35, wherein the absorbent material includes an absorbent sheet.

38. The composition of claim 37, wherein the organic solvent and the water are permeated onto separate portions of the absorbent sheet.

39. A method for cleaning and refreshing clothing, the method comprising the steps of:

a) placing clothing and an absorbent material in a drying machine, wherein the absorbent material is permeated with substances including
51%–98% by weight of an organic solvent; and
1%–35% by weight of water; and b) tumbling the absorbent material with the clothing at a temperature of at least 40° C. in the drying machine in heated air generated by the machine; and c) removing the clothing from the drying machine.

40. The method of claim 39, wherein the clothing and absorbent material are placed into a container prior to placing the clothing and material into the drying machine.

41. The method of claim 40, wherein the container is an air-permeable container containing a plurality of perforations.

42. The method of claim 39, wherein the clothing and absorbent material are placed into the drying machine without first enclosing the clothing and absorbent material in a container.

43. The method of claim 39, wherein the clothing and absorbent material are placed into the drying machine so that the clothing and absorbent material may tumble freely within the drying machine.

44. The method of claim 39, wherein the drying machine is a household hot-air clothes dryer.

45. The method of claim 39, wherein the substances further include an emulsifier, the emulsifier constituting 1–14% by weight of the substances permeated in the absorbent material.

46. The method of claim 39, wherein the substances further include a perfume, the perfume constituting 1–5% by weight of the substances permeated in the absorbent material.

47. The method of claim 39, wherein the substances further include a surfactant, the surfactant constituting 1–5% by weight of the substances permeated in the absorbent material.

48. The method of claim 39, wherein the organic solvent includes at least one of a paraffin, olefin, acetylene and mixtures thereof.

* * * * *